US007153006B1

(12) United States Patent
Lin

(10) Patent No.: US 7,153,006 B1
(45) Date of Patent: Dec. 26, 2006

(54) LAMP ASSEMBLY OF FLASHLIGHT DEVICE

(76) Inventor: Ming-Hui Lin, 5F, No. 43, Lane 3, Sec. 1, Zhongzheng E. Rd., Danshui Town, Taipei County 251 (TW)

( * ) Notice: Subject to any disclaimer, the term of this patent is extended or adjusted under 35 U.S.C. 154(b) by 0 days.

(21) Appl. No.: 11/318,855

(22) Filed: Dec. 28, 2005

(51) Int. Cl.
*F21V 17/10* (2006.01)

(52) U.S. Cl. ..... 362/455; 362/433; 362/434; 362/208

(58) Field of Classification Search ..... 362/208, 362/433–434, 455, 457, 268
See application file for complete search history.

(56) References Cited

U.S. PATENT DOCUMENTS 4,733,337 A * 3/1988 Bieberstein ..... 362/206
5,142,458 A * 8/1992 Brunson ..... 362/184
5,267,131 A * 11/1993 Anthony et al. ..... 362/208
6,837,599 B1 * 1/2005 Liaw et al. ..... 362/473
7,004,600 B1 * 2/2006 Echterling ..... 362/187
2005/0036321 A1 * 2/2005 Ward ..... 362/365

* cited by examiner

*Primary Examiner*—Renee Luebke
*Assistant Examiner*—Robert May
(74) *Attorney, Agent, or Firm*—Leong C. Lei

(57) ABSTRACT

A lamp assembly for a flashlight device is provided, which contains a lamp member, at least an optical lens, and a rim member. The lamp member has a lamp housed in a closed casing with a transparent lens at an end of the closed casing. Around and at the outer side of the transparent lens, the lamp member has a flanged rim with a number of L-shaped notches configured around the inside circumference of the flanged rim. Correspondingly, the rim member has a number of wedges protruding from the outside circumference of the rim member. The rim member is joined to the flanged rim by making the wedges slide into the L-shaped notches, and the optical lens is thereby fixed between the rim member and the transparent lens.

2 Claims, 3 Drawing Sheets

LAMP ASSEMBLY OF FLASHLIGHT DEVICE

BACKGROUND OF THE INVENTION (a) Technical Field of the Invention

The present invention generally relates to flashlight devices, and more particularly to the lamp assembly of a flashlight device.

(b) Description of the Prior Art

A conventional flashlight device has a lamp assembly at an end of an elongated body of the flashlight device. The lamp assembly usually has a transparent lens to seal a lamp inside the lamp assembly, and to protect the lamp from moist and dust. The lamp usually emits white or light yellow light. To have light with different color or to have mat and softened light, an optical lens such as a filter lens or a mat lens has to be employed to process the white or light yellow light from the lamp.

Conventionally, the optical lens is installed between the lamp and the transparent lens inside the lamp assembly, which requires the disassembly of the lamp assembly. This approach not only is inconvenient, but also subjects the optical lens directly to the heat of the lamp. Alternatively, the optical lens has a bushing around its circumference so that it can be sleeved over the lamp assembly in front of the transparent lens. This approach is not economical as the bushing can only fit on a specific flashlight device, in addition to the increased cost of the optical lens.

SUMMARY OF THE INVENTION

The primary purpose of the present invention is to provide a lamp assembly in which the installation of the optical lens on a flashlight device is both convenient and easy.

The lamp assembly contains a lamp member, at least an optical lens, and a rim member. The lamp member has a lamp housed in a closed casing with a transparent lens at an end of the closed casing. Around and at the outer side of the transparent lens, the lamp member has a flanged rim with a number of L-shaped notches configured around the inside circumference of the flanged rim. Correspondingly, the rim member has a number of wedges protruding from the outside circumference of the rim member. The rim member is joined to the flanged rim by making the wedges slide into the L-shaped notches, and the optical lens is thereby fixed between the rim member and the transparent lens.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figures 1, 1A:
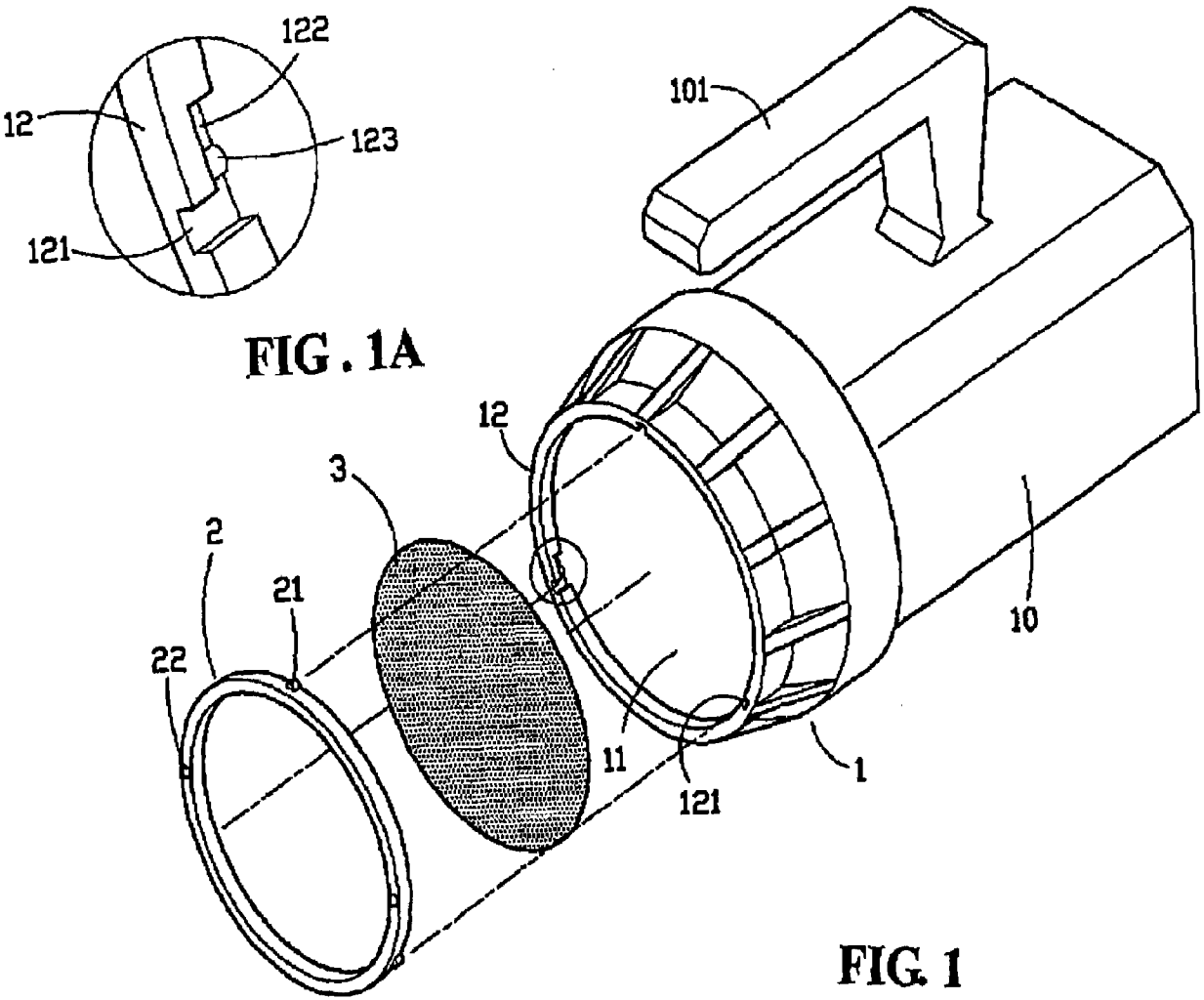
FIG. 1 is a perspective exploded view showing the lamp assembly according to an embodiment of the present invention.
FIG. 1A is an enlarged view of a portion of FIG. 1.

FIG. 1 is a perspective exploded view showing the lamp assembly according to an embodiment of the present invention. FIG. 1A is an enlarged view of a portion of FIG. 1. As illustrated, the lamp assembly is installed at an end of the body 10 of a flashlight device having a handle 101 on the body 10. The lamp assembly contains a lamp member 1, at least an optical lens 3, and a rim member 2. For ease of reference, a location is said to be at the outer or inner side if it is closer to or farther away from the body 10. Similarly, a location is said to be at the outside or the inside if it is farther away from or closer to the axis of the body 10.

The lamp member 1 has a lamp (not shown) housed in a closed casing (not numbered) with a transparent lens 11 at an end of the closed casing along the path of light from the lamp. Around and at the outer side of the transparent lens 11, the casing has a flanged rim 12 with a number of L-shaped notches (not numbered) configured along the inside circumference of the flanged rim 12. Each of the notches contains a first groove 121 along the axial direction of the flanged rim 12 and a second groove 122 perpendicular to the first groove 121, jointly forming the L shape of the notches. Additionally, a bump 123 is configured at an appropriate location along the second groove 122. Correspondingly, the rim member 2 has a number of wedges 21 protruding from the outside circumference of the rim member 2, and a number of nubs 22 configured on the outer surface of the rim member 2. The optical lens 3 has a shape so that it can fit inside the flanged rim 12.

Figure 2:
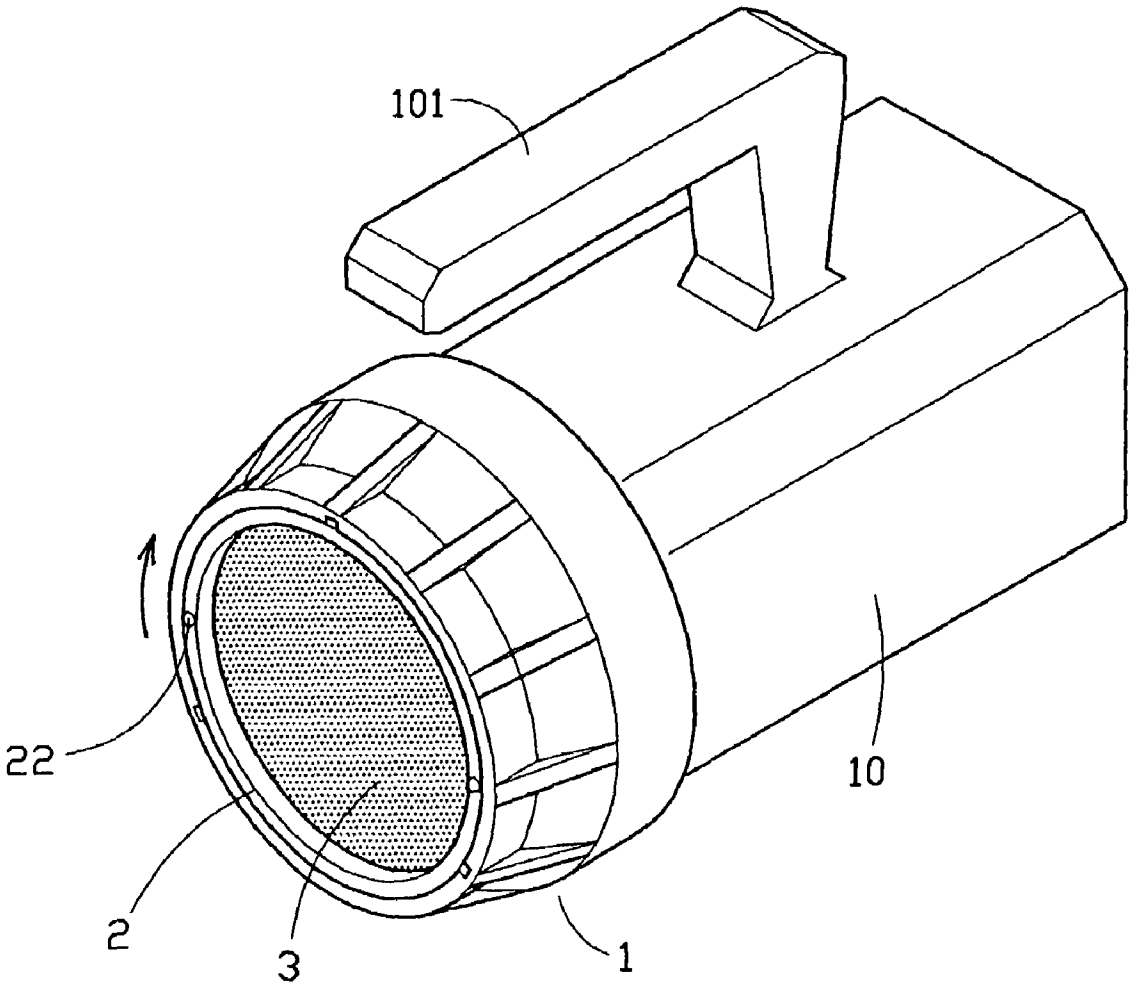
FIG. 2 is a perspective view showing the assembly of the lamp assembly of FIG. 1.
Figure 3:
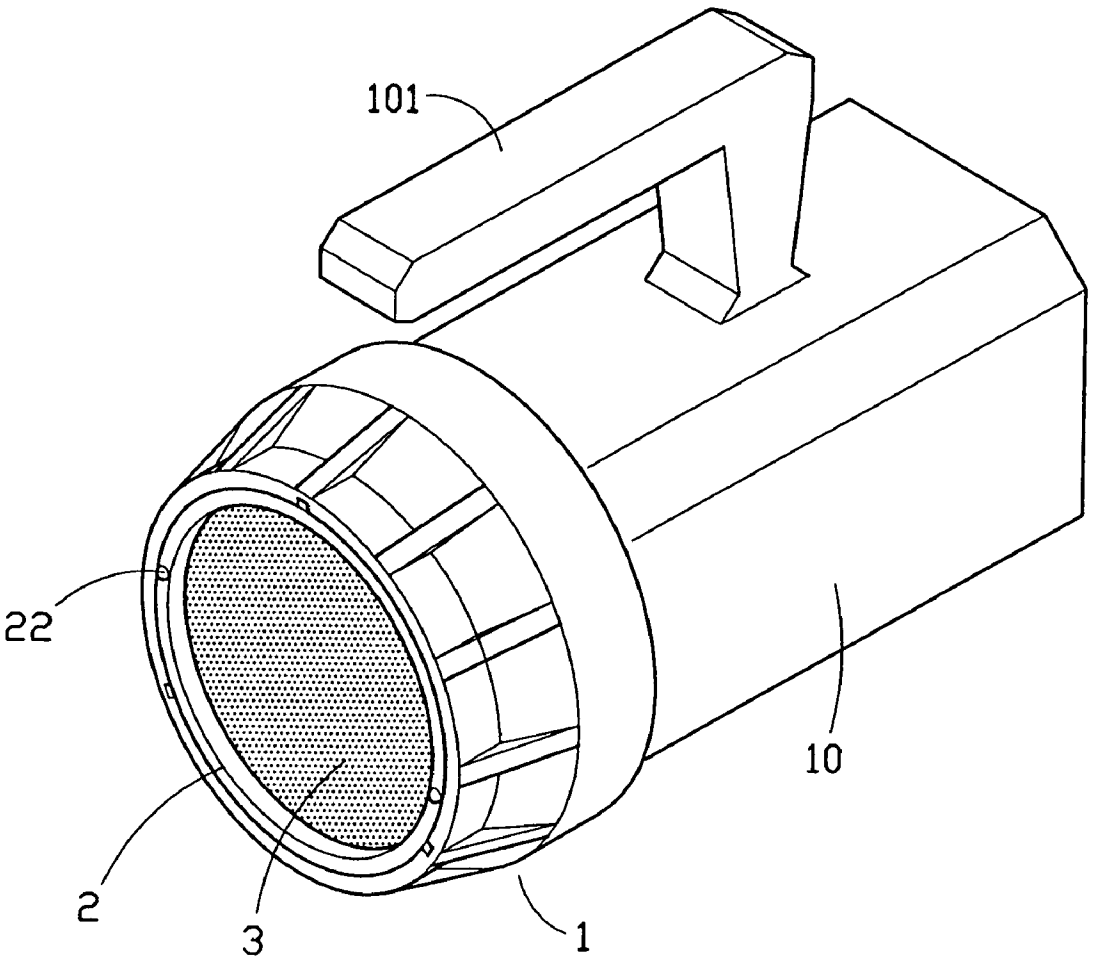
FIG. 3 is a perspective view showing the appearance of the lamp assembly of FIG. 1 after its assembly.

FIG. 2 is a perspective view showing the assembly of the lamp assembly of FIG. 1. As illustrated, to assemble the lamp assembly, the optical lens 3 is first placed in front of and attached to the transparent lens 11 inside the flanged rim 12. Then, the rim member 2 is joined to the flanged rim 12 by having the wedges 21 aligned with and inserted into the first grooves 121. By using the nubs 22, the rim member 2 is twisted so that the wedges 21 slide into the second grooves 122 and cross the bumps 123. As such, the wedges 21 are confined by said bumps 123 inside the second grooves 122. The rim member 2 is thereby locked to the flanged rim 12 and the optical lens 3 is fixed between the rim member 2 and the transparent lens 11. The completed lamp assembly is shown in FIG. 3.

In an alternative embodiment, corresponding screw threads are configured around the outside circumferences of the rim member 2 and the inside circumference of the flanged rim 12 respectively so that the rim member 2 is screwed into and locked to the flanged rim 12.

As described, the lamp assembly according to the present invention has a simple yet sturdy structure and the replacement of the optical lens could be conducted conveniently and easily. Further, the optical lens requires no customization in order to be used on a flashlight device It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lamp assembly of a flashlight device, comprising:

a lamp member positioned at an end of a body of said flashlight device, said lamp member comprising a closed casing, a lamp housed inside said casing, and a transparent lens positioned at an end of said casing along the path of light from said lamp, said casing having a flanged rim around and at the outer side of said transparent lens;

at least an optical lens positioned inside said flanged rim and attached to the outer side of said transparent lens of said lamp member; and a rim member joined to said flanged rim so that said optical lens is fixed between said rim member and said transparent lens;

wherein said flanged rim has a plurality of L-shaped notches configured along an inside circumference of said flanged rim; each of said notches comprises a first groove along the axial direction of said flanged rim and a second groove perpendicular to said first groove, jointly forming the L shape of said notches; said rim member has a plurality of wedges protruding from an outside circumference of said rim member; and said rim member is joined to said flanged rim by having said wedges aligned with and inserted into said first grooves, and by twisting said rim member so that said wedges are slid into said second grooves; a bump is configured at an appropriate location along each of said second grooves so as to, when said wedges slide into said second grooves and cross said bumps, confine said wedges inside said second grooves.

2. The lamp assembly according to claim 1, wherein a plurality of nubs are configured on the outer surface of said rim member to facilitate the twist of said rim member.

* * * * *